US012290168B2

(12) United States Patent
Kuyl

(10) Patent No.: US 12,290,168 B2
(45) Date of Patent: May 6, 2025

(54) FIREARM RACK KITS FOR WIRE SHELF SYSTEMS

(71) Applicant: Marinus Du Preez Kuyl, Forest Grove, OR (US)

(72) Inventor: Marinus Du Preez Kuyl, Forest Grove, OR (US)

( * ) Notice: Subject to any disclaimer, the term of this patent is extended or adjusted under 35 U.S.C. 154(b) by 159 days.

(21) Appl. No.: 18/221,307

(22) Filed: Jul. 12, 2023

(65) Prior Publication Data

US 2025/0017369 A1 Jan. 16, 2025

(51) Int. Cl.
*A47B 81/00* (2006.01)
*A47B 55/02* (2006.01)
*A47F 7/00* (2006.01)

(52) U.S. Cl.
CPC ..... *A47B 81/005* (2013.01); *A47B 55/02* (2013.01); *A47F 7/0021* (2013.01); *A47F 7/0028* (2013.01)

(58) Field of Classification Search
CPC ..... A47B 81/00; A47B 81/005; A47B 55/02; A47F 7/0021; A47F 7/0028; A47F 7/0035
USPC ..... 211/64, 70.8
See application file for complete search history.

(56) References Cited

U.S. PATENT DOCUMENTS 731,642 A * 6/1903 Wilder ..... A47K 1/09 211/65
838,473 A * 12/1906 Speiser ..... A47K 1/09 211/65
1,202,588 A * 10/1916 Roberts ..... A47B 81/00 312/297
2,070,904 A * 2/1937 Jennings ..... A47B 81/005 211/64
2,587,226 A * 2/1952 Rodman ..... B25H 3/04 211/65
2,623,639 A * 12/1952 Levy ..... A47B 81/005 211/64
4,006,825 A * 2/1977 Austin ..... A47F 7/0035 211/64
4,113,107 A * 9/1978 Jaeger ..... F41A 17/02 211/64
4,461,385 A * 7/1984 Clouser ..... A47B 81/005 42/70.11
5,257,700 A * 11/1993 Wallace ..... A47B 81/005 211/106
5,265,950 A * 11/1993 Atkinson ..... A47B 81/005 211/64

(Continued)

*Primary Examiner* — Stanton L Krycinski
(74) *Attorney, Agent, or Firm* — Mohr Intellectual Property Law Solutions, PC

(57) ABSTRACT

Firearm rack kits for wire shelf systems. The firearm rack kits include a first bracket, a second bracket, and an upper support member. The first bracket and the second bracket are complementarily configured with the wire shelf system to releasably mount to a wire shelf of the wire shelf system. The second bracket is complementarily configured to releasably mount to the wire shelf in a position laterally spaced from the first bracket. The upper support member defines a barrel cutout configured to receive and support a barrel of a firearm. The upper support member is configured to span between the first bracket and the second bracket and to releasably couple to the first bracket and to the second bracket. In some examples, the firearm rack kit includes a floor member. In some examples, the firearm rack kit includes a butt support member.

20 Claims, 11 Drawing Sheets

(56) References Cited

U.S. PATENT DOCUMENTS

| | | | | |
|---|---|---|---|---|
| 5,657,883 | A * | 8/1997 | Badia | A01K 97/10 D6/552 |
| 6,116,436 | A * | 9/2000 | Ferrucci | G11B 33/0444 |
| 6,386,657 | B1 * | 5/2002 | Frifeldt | A47B 55/02 211/186 |
| 6,749,074 | B1 * | 6/2004 | Hileman | A47F 7/0028 211/85.7 |
| 7,478,892 | B2 * | 1/2009 | Punzel | E05C 9/043 312/351 |
| 7,524,002 | B2 * | 4/2009 | Punzel | A47B 81/005 312/215 |
| 7,770,740 | B2 * | 8/2010 | Punzel | F41A 23/18 211/64 |
| 8,371,458 | B2 * | 2/2013 | Yu | A47F 5/0892 52/39 |
| 10,182,653 | B1 * | 1/2019 | Long | A47B 81/005 |
| 10,362,868 | B2 * | 7/2019 | Haug | A47B 81/02 |
| 11,566,868 | B2 * | 1/2023 | Mack | F41C 33/06 |
| D991,716 | S * | 7/2023 | Zhang | D6/675 |
| 11,751,685 | B2 * | 9/2023 | Hall | A47B 51/00 211/113 |
| 11,819,126 | B2 * | 11/2023 | Schofield | F41A 17/44 |
| 11,903,482 | B2 * | 2/2024 | Honermann | F41C 33/06 |
| 2007/0024165 | A1 * | 2/2007 | Moulton | A47B 81/005 312/291 |
| 2007/0170128 | A1 * | 7/2007 | Punzel | A47B 81/005 211/64 |
| 2013/0002116 | A1 * | 1/2013 | Lodge | A47B 81/00 312/351.1 |

* cited by examiner

FIREARM RACK KITS FOR WIRE SHELF SYSTEMS

BACKGROUND

The present disclosure relates generally to firearm rack kits. In particular, firearm rack kits for wire shelf systems are described.

Firearms are popular with many people for target shooting, self-defense, and as collectables. Firearms come in a wide variety of configurations, such as handguns and long guns. This document will focus on long gun firearm configurations, such as rifles and shotguns, and will refer to them simply as firearms.

In this document, the term firearm is used broadly to encompass a range of guns configured to shoot various objects by various means. In addition to guns meeting the technical definition of a firearm, firearms in this document should be understood to cover air rifles, such as pellet guns, AirSoft guns, and paintball guns. The term firearm should also be understood to include rifles that are not technically classified as firearms by the Bureau of Alcohol, Tobacco, and Firearms, such as black powder rifles or muzzleloaders.

Storing firearms presents a host of challenges given their size and length. Known solutions for storing firearms are not entirely satisfactory. For example, existing solutions for storing firearms are big, bulky, heavy, and difficult to ship. Some firearm storage solutions require means to unlock them, which limits their usefulness in public settings like a target shooting range.

Wire shelf systems are popular storage solutions for people to have in their homes and businesses. Wire shelf systems are strong, light, customizable, and easy to ship. Many people already own and utilize wire shelf systems and can easily and inexpensively purchase them.

It would be desirable to add firearm storage capabilities to a wire shelf system. It would be helpful to have a firearm storage solution that was adjustable to accommodate different sized firearms and different storage configurations. It would be advantageous if a firearm storage solution could be made flat packable to make shipping more economical.

Thus, there exists a need for firearm rack kits that improve upon and advance the design of known solutions for storing firearms. Examples of new and useful firearm rack kits relevant to the needs existing in the field are discussed below.

SUMMARY

The present disclosure is directed to firearm rack kits for wire shelf systems. The firearm rack kits include a first bracket, a second bracket, and an upper support member. The first bracket and the second bracket are complementarily configured with the wire shelf system to releasably mount to a wire shelf of the wire shelf system. The second bracket is complementarily configured to releasably mount to the wire shelf in a position laterally spaced from the first bracket. The upper support member defines a barrel cutout configured to receive and support a barrel of a firearm. The upper support member is configured to span between the first bracket and the second bracket and to releasably couple to the first bracket and to the second bracket. In some examples, the firearm rack kit includes a floor member and/or a butt support member.

In some examples, the first bracket includes a main member, a coupling rail, and a fastener. The upper support member may releasably couple to the main member. The main member may be configured to be disposed on a first side of a lip of the wire shelf. The coupling rail may be configured to be disposed on a second side of the lip of the wire shelf opposite the first side of the lip. The fastener may be configured to couple the main member to the coupling rail through the lip of the wire shelf.

This document describes certain examples where the main member defines a first fastener port complementarily configured with the fastener, the coupling rail defines a second fastener port complementarily configured with the fastener, and the first fastener port and the second fastener port are aligned when the bracket is releasably mounted to the wire shelf.

In select embodiments, the first fastener port and the second fastener port are aligned with a gap between support wires of the wire shelf.

As described below, in particular instances the fastener is threaded and rotating the fastener in a first direction compresses the lip of the shelf between the coupling rail and the main member.

In certain examples, one or more of the first bracket, the second bracket, and the upper support member are formed from metal plates. In other examples, one or more of the first bracket, the second bracket, and the upper support member are formed from structural wire.

As discussed below, the firearm rack kit may include a floor member spaced below the upper support member and releasably secured to the wire shelf system.

Additionally or alternatively, the firearm rack kit may include a butt support member releasably supported on the floor member and configured to support a butt of a firearm when a barrel of the firearm is received in the barrel cutout. In some examples, the butt support member and the floor member cooperate to adjust the position of the butt support member relative to the floor member.

This document describes certain examples where the floor member defines a series of holes defining a range of positions. The butt support member may be configured to secure to one or more selected holes in the series of holes to position the butt support member in a desired position within the range of positions.

In select embodiments, the butt support member includes a body defining a butt support recess complementarily configured with a butt of a firearm.

In some examples, the inclined surface is configured to tilt the firearm towards a back of the upper support member to cause a barrel of the firearm to rest against the barrel support cutout.

In some examples, the upper support member is disposed closer to a rear of the wire shelf system than the floor member, and the barrel support cutout is open towards a front of the wire shelf system opposite the rear of the wire shelf system.

In certain examples, the upper support member includes a cushion layer disposed along an edge of the barrel support cutout.

In certain examples, the upper support member defines a plurality of laterally adjacent barrel support cutouts. In certain examples, the barrel support cutout defines a first barrel support cutout, the first barrel support cutout is defined in a front portion of the upper support member, the upper support member defines a second barrel support cutout, and the second barrel support cutout is defined in a rear portion of the upper support member opposite the front portion.

In certain examples, the upper support member includes a bumper disposed proximate to a vertical support member of the wire shelf system when the upper support member is releasably mounted to the wire shelf, and the bumper is configured to restrict the upper support member from moving laterally relative to the wire shelf system by abutting the vertical support member of the wire shelf system.

In certain examples, the first bracket, the second bracket, and the upper support member are substantially planar and configured to pack flat together when not mounted to the wire shelf system.

DETAILED DESCRIPTION

Figure 1:
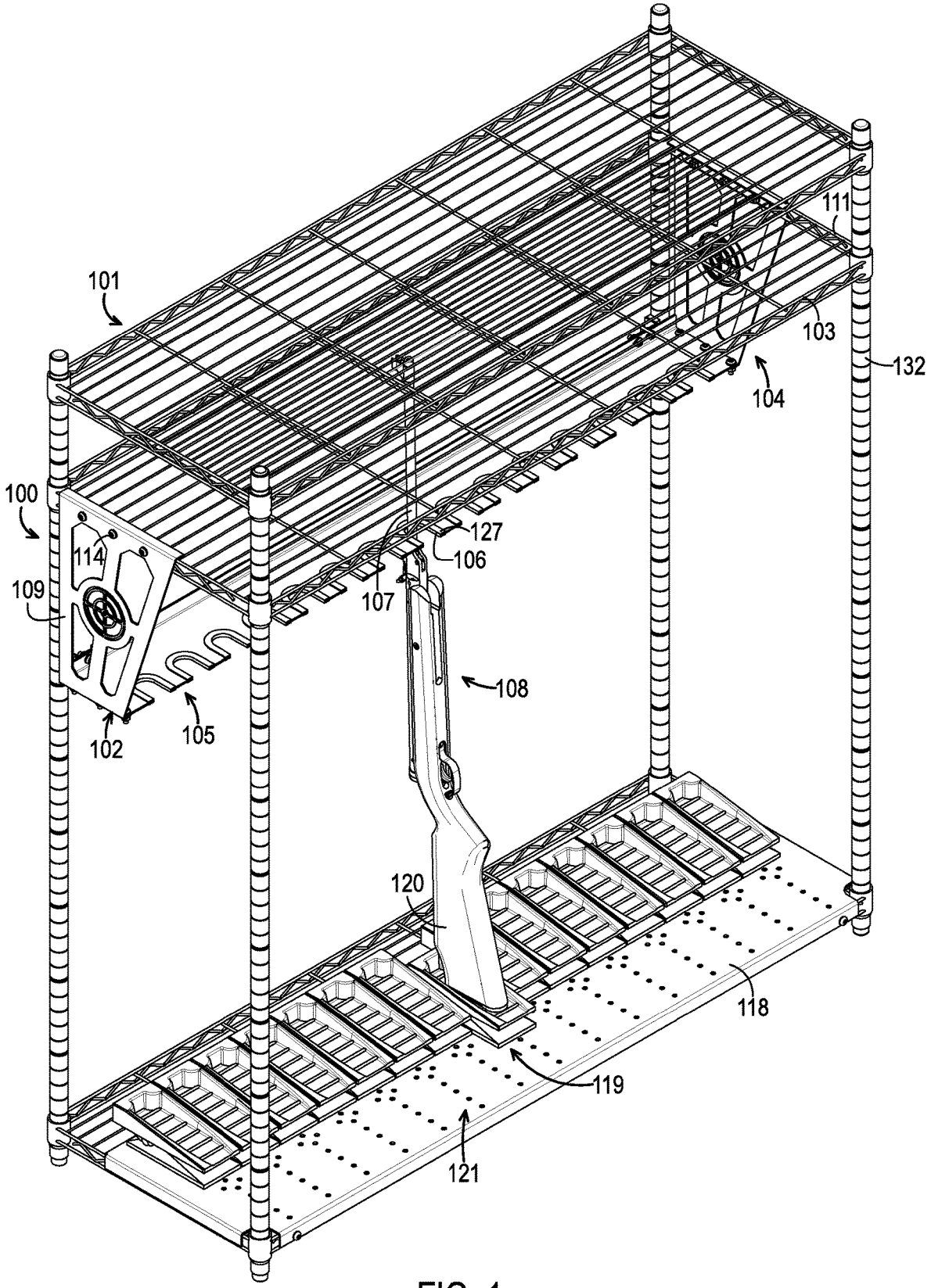
FIG. 1 is a perspective view of a firearm rack kit mounted to a wire shelf and supporting a firearm.

The disclosed firearm rack kits will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various firearm rack kits are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Firearm Rack Kits for Wire Shelf Systems

With reference to the figures, firearm rack kits for wire shelf systems will now be described. The firearm rack kits discussed herein function to conveniently store firearms when mounted to a wire shelf system.

The reader will appreciate from the figures and description below that the presently disclosed firearm rack kits address many of the shortcomings of conventional solutions for storing firearms. For example, the novel firearm rack kits described below are relatively compact, light, and easy to ship. The novel firearm rack kits discussed herein do not require means to unlock them, which allows them to be conveniently used in public settings like a target shooting range.

Desirably, the novel firearm rack kits discussed in this document add firearm storage capabilities to wire shelf systems that many people already utilize or can easily acquire. The novel firearm rack kits are adjustable to accommodate different sized firearms and different storage configurations. Advantageously, the novel firearm rack kits discussed herein are flat packable to make shipping them more economical.

Contextual Details

Ancillary features relevant to the firearm rack kits described herein will first be described to provide context and to aid the discussion of the firearm rack kits.

Wire Shelf System

The firearm rack kits discussed herein are configured to mount to wire shelf systems. Examples of suitable wire shelf systems include wire shelf systems 101, 201, and 301 shown in the figures. With reference to FIG. 1, the reader can see that wire shelf system 101 includes wire shelves 103 and vertical support members 132. The components of wire shelf system 101 are discussed further in the sections below.

The wire shelf system may be any currently known or later developed type of wire shelf system. Various wire shelf system types exist and could be used in place of the wire shelf system shown in the figures. In addition to the types of wire shelf systems existing currently, it is contemplated that the firearm rack kits described herein could be used with new types of wire shelf systems developed in the future.

In the present example, the wire shelf system is composed primarily of metal wire. However, the wire shelf system may be composed of any currently known or later developed material suitable for shelf applications.

The size and shape of the wire shelf system may be varied as needed for a given application. In some examples, the wire shelf system is larger relative to the firearm rack kit than depicted in the figures. In other examples, the wire shelf system is smaller relative to the firearm rack kit than depicted in the figures. Further, the wire shelf system and the firearm rack kit may each be larger or smaller than described herein while maintaining their relative proportions.

Wire Shelf

The firearm rack kits discussed herein are designed to mount to a wire shelf of a wire shelf system. Representative wire shelves, such as wire shelf 103, are shown in the figures. As shown in the figures, wire shelf 103 is formed from metal wire and includes a lip 111. Wire shelf 103 is vertically adjustable on vertical support members 132.

The size and shape of the wire shelf may be varied as needed for a given application. In some examples, the wire shelf is larger relative to the other components than depicted in the figures. In other examples, the wire shelf is smaller relative to the other components than depicted in the figures. Further, the wire shelf and the other components may all be larger or smaller than described herein while maintaining their relative proportions.

Vertical Support Members

Vertical support members 132 support wire shelves 103 at selected heights. By adjusting the position of wire shelf 103 relative to vertical support members 132, the height of firearm rack kit 100 mounted to wire shelf 103 can correspondingly be adjusted.

Firearms

The firearm rack kits discussed herein function to support firearms, such as long guns in the form of rifles and shotguns. A suitable firearm, firearm 108, is shown in FIG. 1 As shown in the figures, the firearm rack kits may support the firearms vertically.

As shown in the figures, firearm 108 includes a butt 120 and a barrel 107. The components of firearm 108 are discussed further in the sections below.

The firearm may be any currently known or later developed type of firearm or gun similar to technical firearms, such as air rifles, such as pellet guns, AirSoft guns, paintball guns, black powder rifles, and/or muzzleloaders. The term firearm should also be understood to include rifles that are not technically classified as firearms by the Bureau of Alcohol, Tobacco, and Firearms, such as black powder rifles or muzzleloaders.

Various firearm types exist and could be used in place of the firearm shown in the figures. In addition to the types of firearms existing currently, it is contemplated that the firearm rack kits described herein could be used with new types of firearms developed in the future.

The number of firearms in the firearm rack kit may vary. The reader should appreciate that the number of firearms may be different in other examples than is shown in the figures. For instance, some firearm rack kit examples support additional or fewer firearms than described in the present example.

The size and shape of the firearm may be varied as needed for a given application. In some examples, the firearm is larger relative to the firearm rack kit than depicted in the figures. In other examples, the firearm is smaller relative to the firearm rack kit than depicted in the figures. Further, the firearm and the firearm rack kit may all be larger or smaller than described herein while maintaining their relative proportions.

Butt

The firearm rack kits discussed herein are configured to support a butt of a firearm. A suitable butt, butt 120, is shown in the figures. However, the butt may be any currently known or later developed type of firearm butt. Various firearm butt types exist and could be used in place of the butt shown in the figures. In addition to the types of firearm butts existing currently, it is contemplated that the firearm rack kits described herein could be used with new types of butts developed in the future.

The size and shape of the butt may be varied as needed for a given application. In some examples, the butt is larger relative to the firearm rack kit than depicted in the figures. In other examples, the butt is smaller relative to the firearm rack kit than depicted in the figures. Further, the butt and the firearm rack kit may all be larger or smaller than described herein while maintaining their relative proportions.

Barrel

The firearm rack kits discussed herein are configured to support a barrel of a firearm. A suitable barrel, barrel 107, is shown in the figures. However, the barrel may be any type of firearm barrel currently known or later developed.

The size and shape of the barrel may be varied as needed for a given application. In some examples, the barrel is larger relative to the firearm rack kit than depicted in the figures. In other examples, the barrel is smaller relative to the firearm rack kit than depicted in the figures. Further, the barrel and the firearm rack kit may all be larger or smaller than described herein while maintaining their relative proportions.

Firearm Rack Kit Embodiment One

Figure 8:
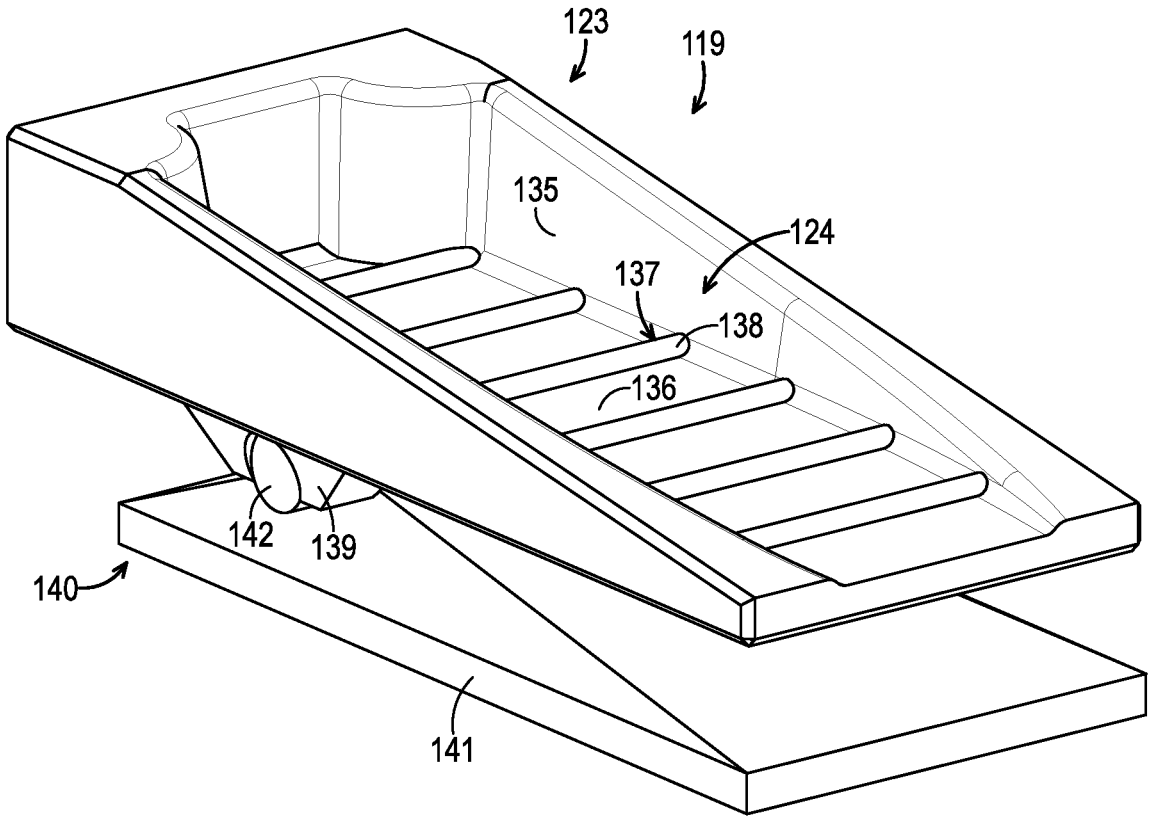
FIG. 8 is a top perspective view of the butt support member shown in FIG. 1.
Figure 9:
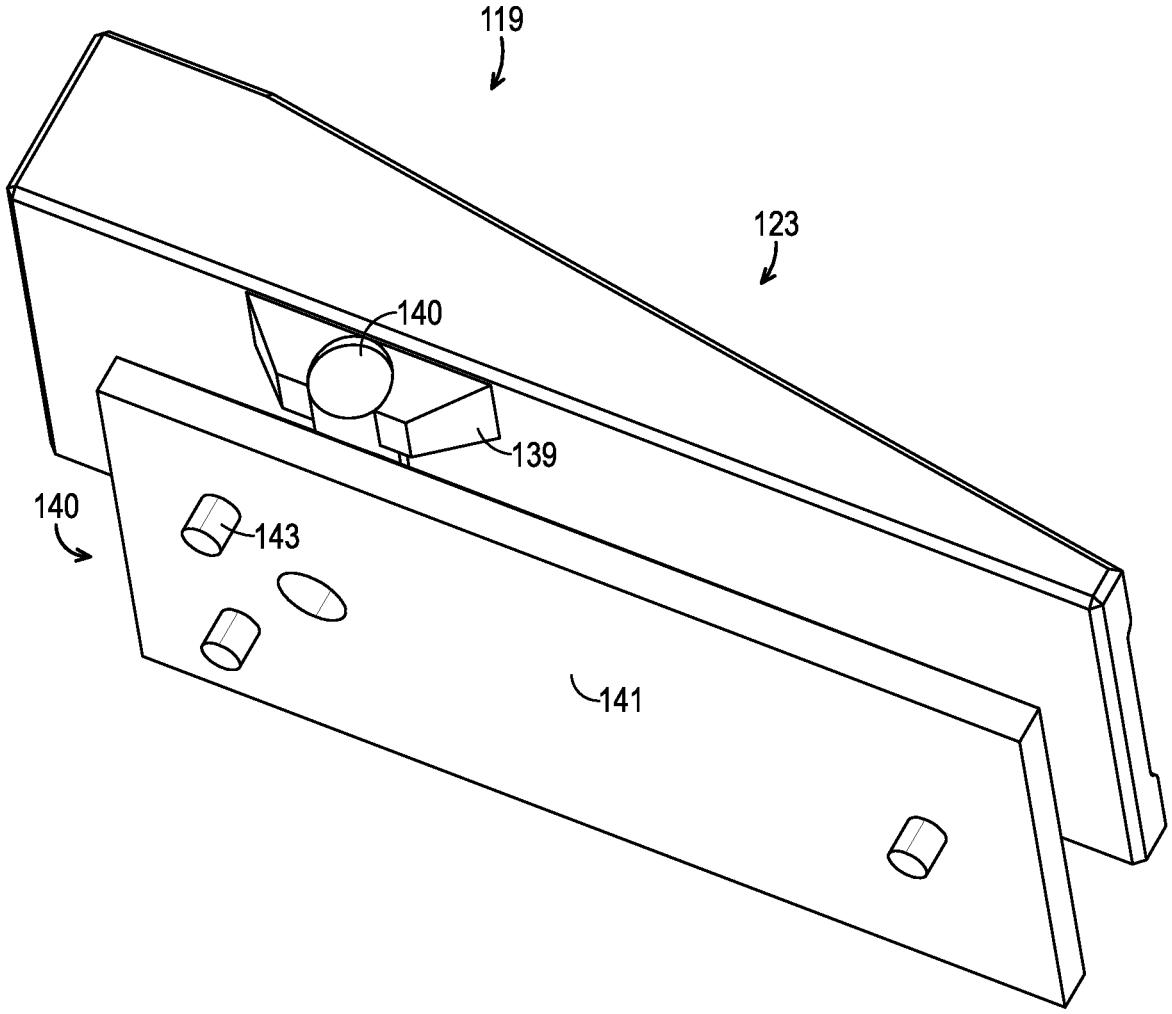
FIG. 9 is a bottom perspective view of the butt support member shown in FIG. 1.
Figure 10:
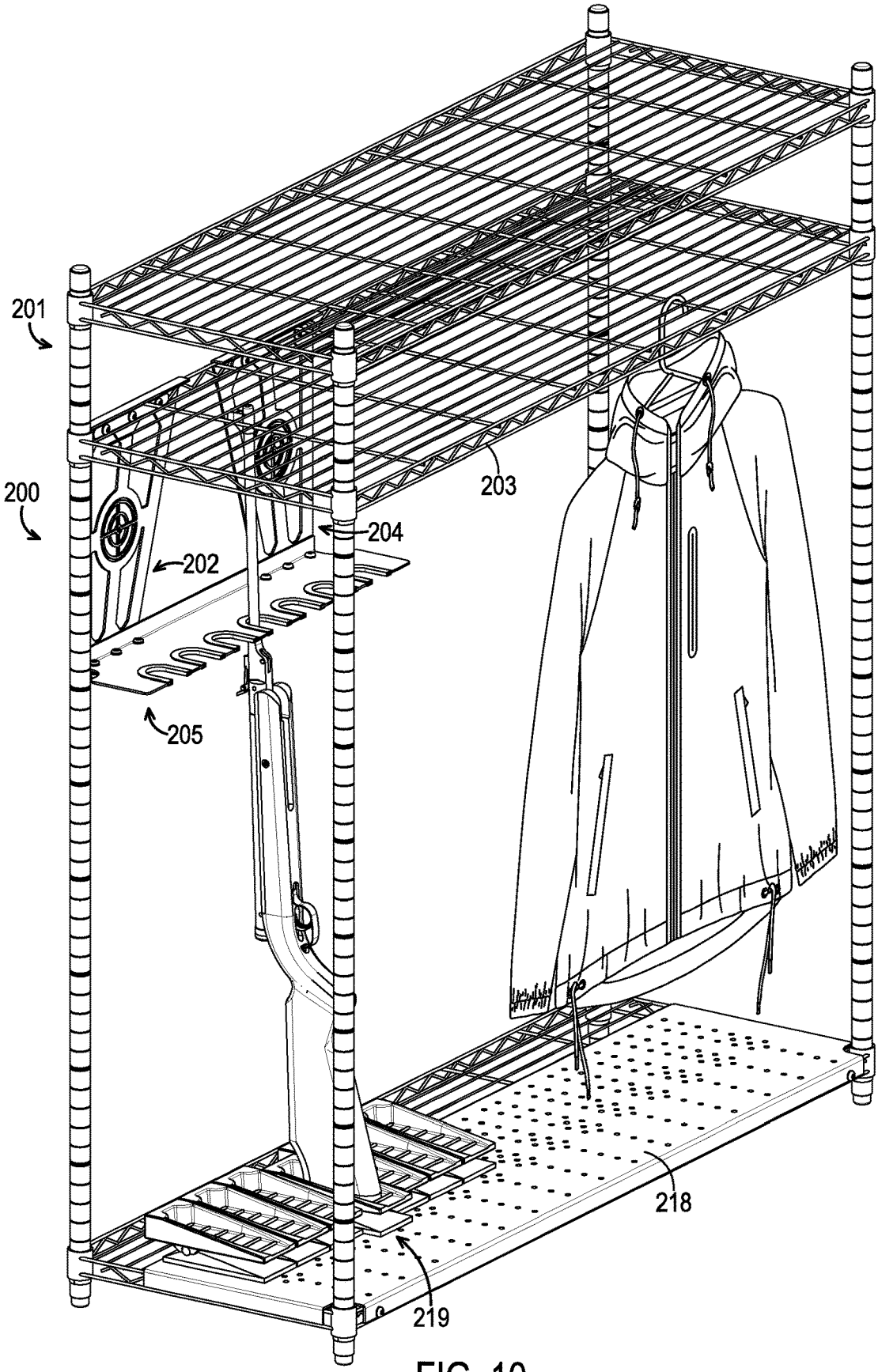
FIG. 10 is a perspective view of a second example of a firearm rack kit mounted to a wire shelf and supporting a firearm.
Figure 11:
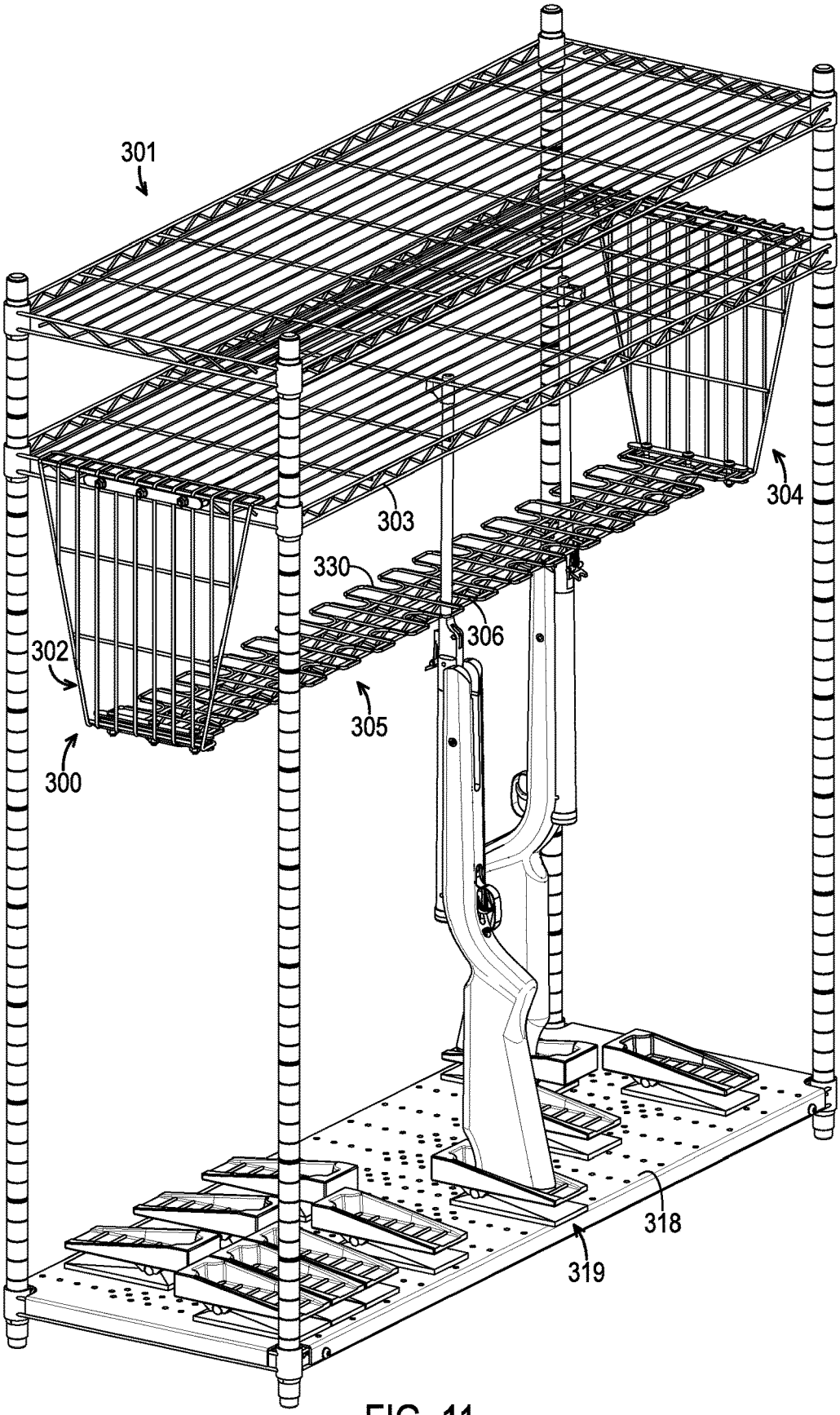
FIG. 11 is a perspective view of a third example of a firearm rack kit mounted to a wire shelf and supporting a firearm.

With reference to FIGS. 1-9, a firearm rack kit 100 will now be described as a first example of a firearm rack kit. A second example of a firearm rack kit, firearm rack kit 200, is shown in FIG. 10 and discussed in the Embodiment Two section below. A third example of a firearm rack kit, firearm rack kit 300, is shown in FIG. 11 and discussed in the Embodiment Three section below.

The reader can see in FIGS. 1 and 3-5 that firearm rack kit 100 is configured to mount to a wire shelf system 101. As shown in FIGS. 1-5, firearm rack kit 100 includes a first bracket 102, a second bracket 104, an upper support member 105, a floor member 118, and a butt support member 119. In other examples, the firearm rack kit includes fewer components than depicted in the figures. In certain examples, the firearm rack kit includes additional or alternative components than depicted in the figures. The components of firearm rack kit 100 are discussed in more detail in the sections below.

The size and shape of the firearm rack kit may be varied as needed for a given application. In some examples, the firearm rack kit is larger relative to the other components than depicted in the figures. In other examples, the firearm rack kit is smaller relative to the other components than depicted in the figures. Further, the firearm rack kit and the other components may all be larger or smaller than described herein while maintaining their relative proportions.

Brackets

The role of the brackets are to selectively couple firearm rack kit 100 to wire shelf system 101. Further, brackets 102 and 104 function to support upper support member 105.

Figure 3:
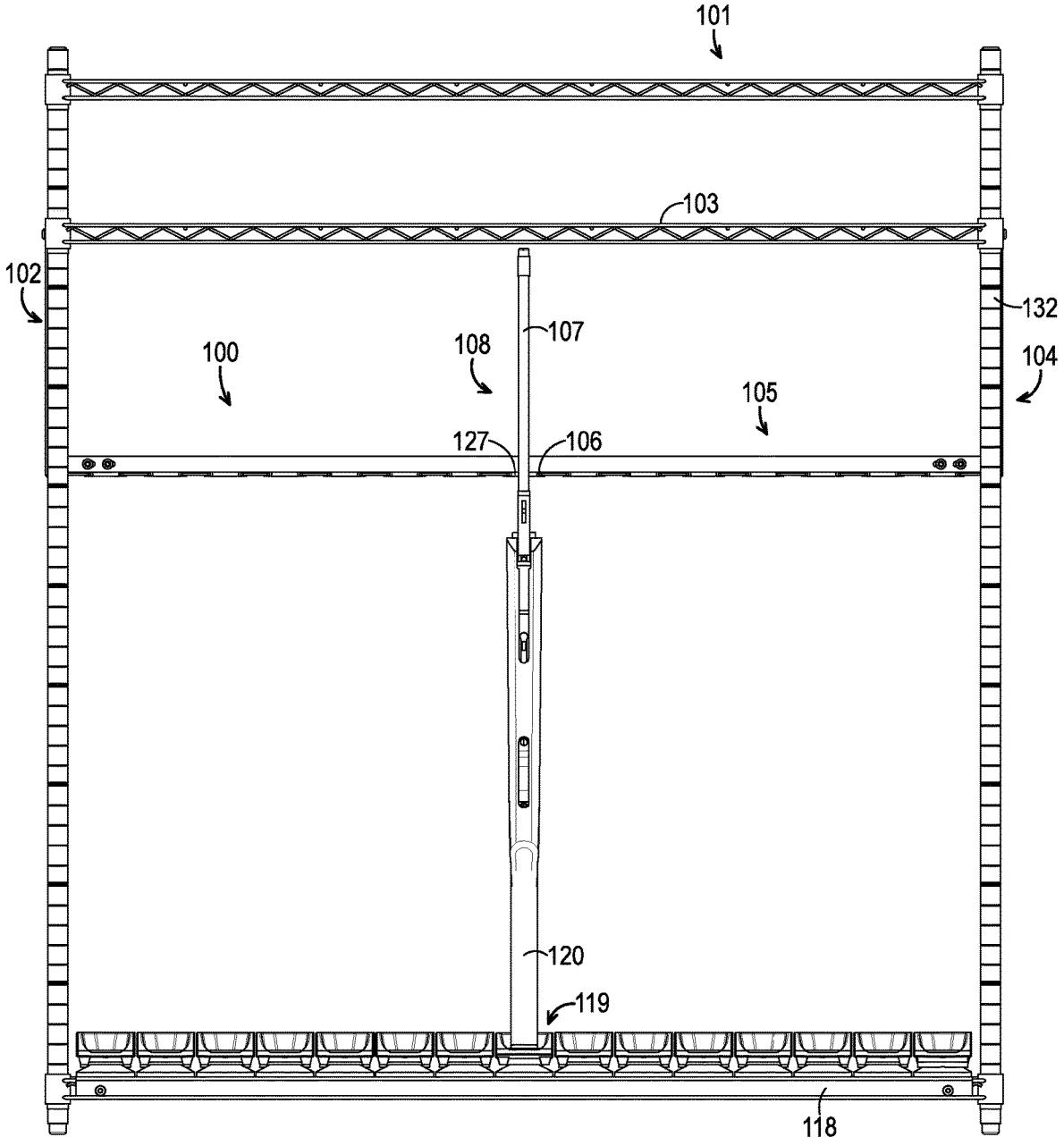
FIG. 3 is a front elevation view of the firearm rack kit mounted to a wire shelf and supporting a firearm.
Figure 4:
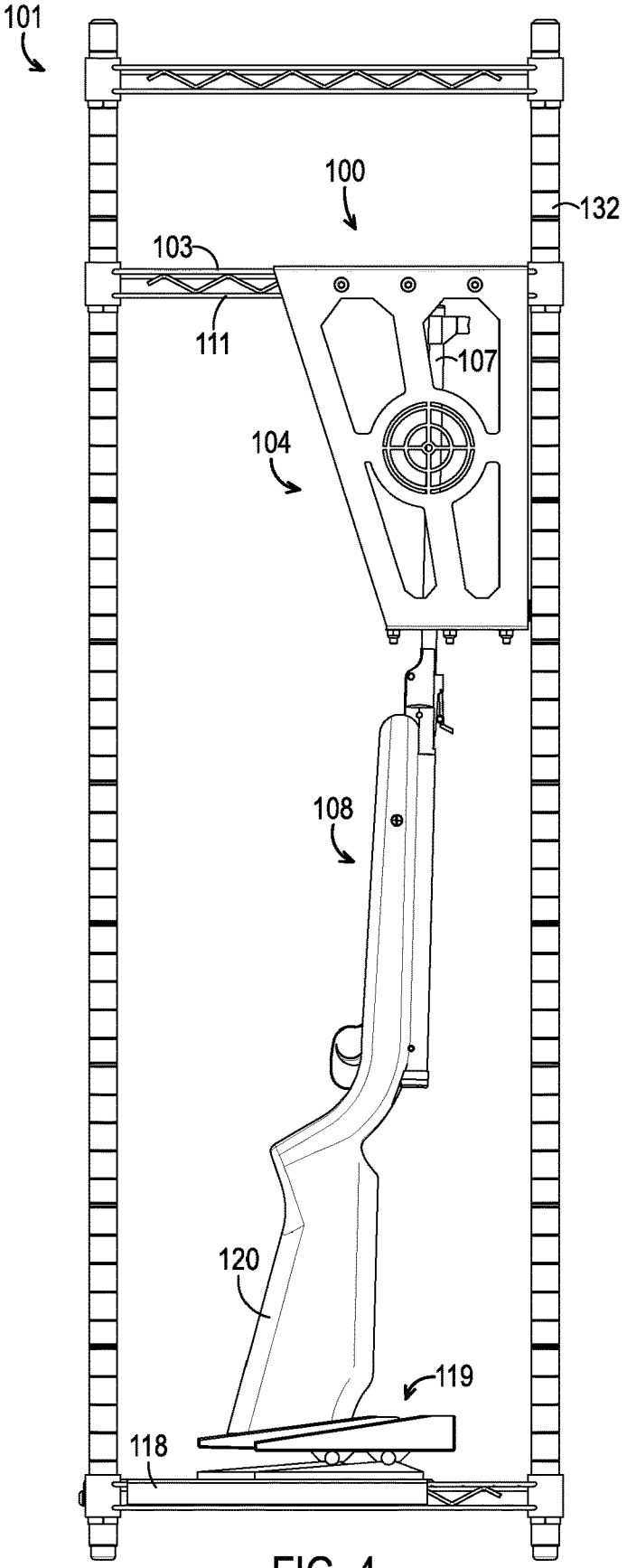
FIG. 4 is a side elevation view of the firearm rack kit mounted to a wire shelf and supporting a firearm.

As depicted in FIGS. 1, 3, and 4, first bracket 102 is complementarily configured with wire shelf system 101 to releasably mount to a wire shelf 103 of wire shelf system 101. With reference to FIGS. 1, 3, and 4, second bracket 104 is also complementarily configured with wire shelf system 101 to releasably mount to wire shelf 103 of wire shelf system 101. Second bracket 104 releasably mounts to wire shelf 103 in a position laterally spaced from first bracket 102.

Figure 5:
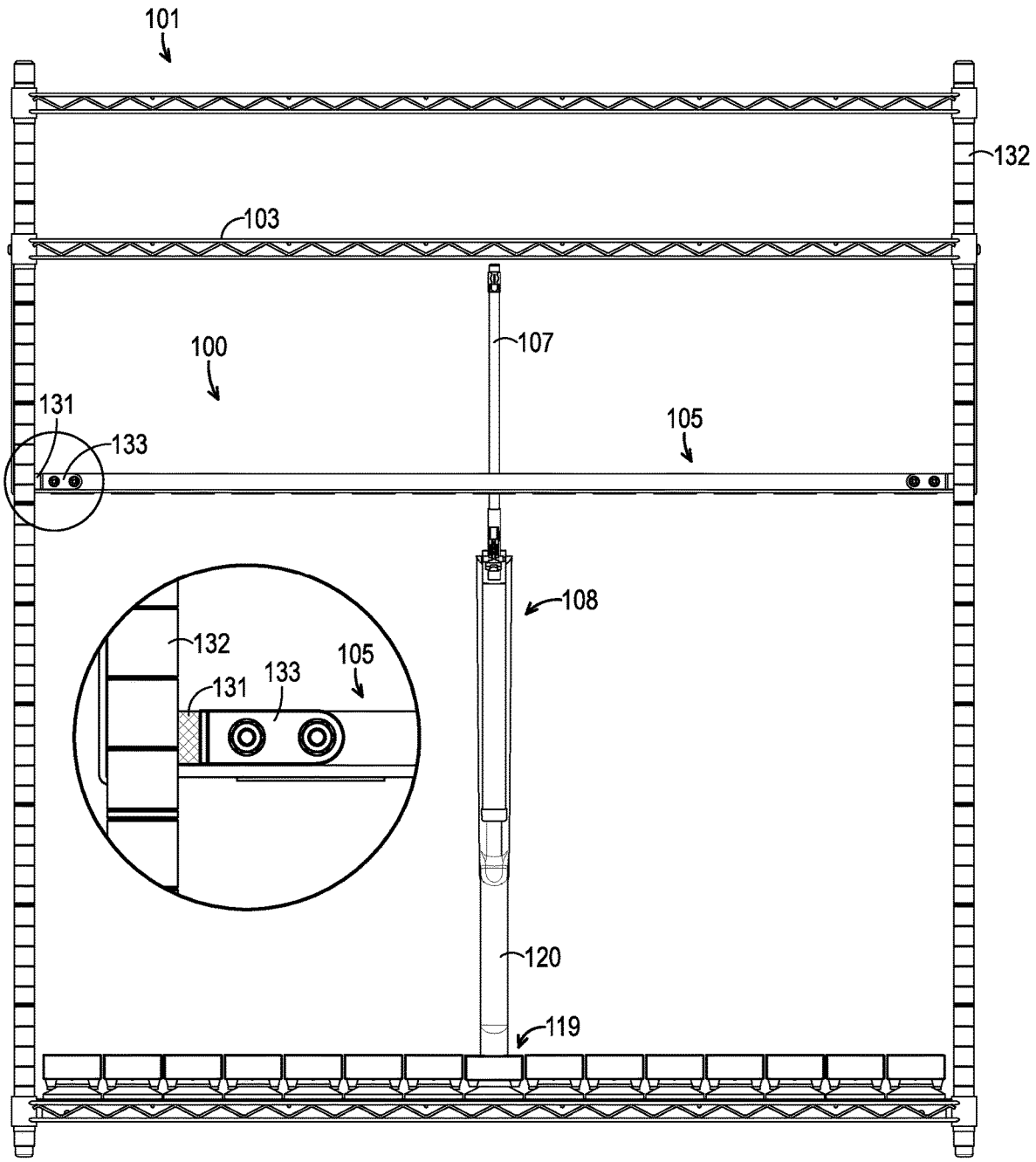
FIG. 5 is a rear elevation view of the firearm rack kit shown in FIG. 1.

As shown in FIGS. 1, 3, and 5, first bracket 102 includes a main member 109, a coupling rail 112, and fasteners 114. Second bracket 104 is configured the same as first bracket 102, and thus, the features of second bracket 104 will not be redundantly discussed separately. The components of first bracket 102 are described in more detail in the sections below.

Figure 2:
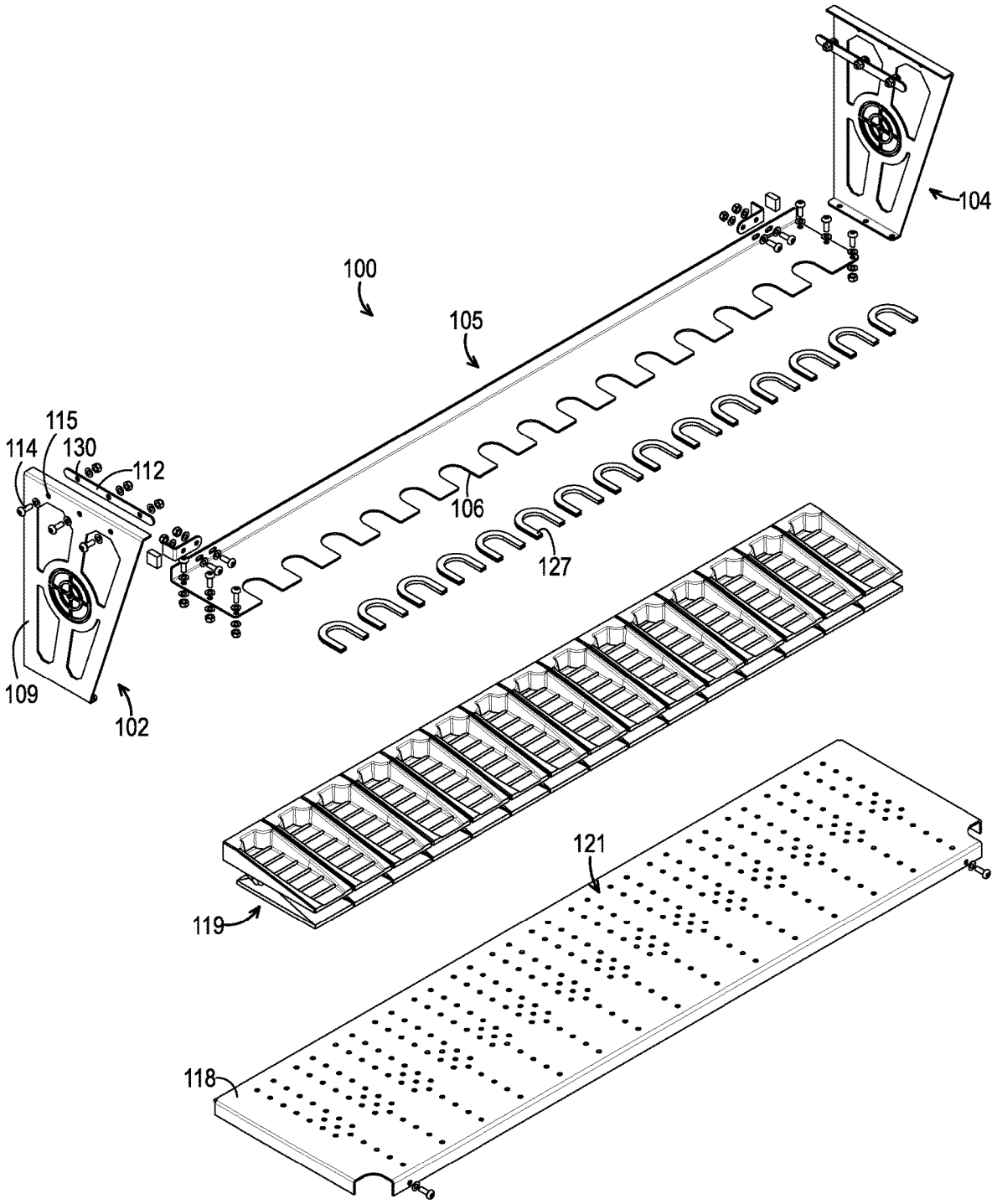
FIG. 2 is a view of the firearm rack kit shown in FIG. 1 in a disassembled state.

A brief note about packability. As depicted in FIG. 2, first bracket 102, second bracket 104, upper support member 105, and floor member 118 are substantially planar. Moreover, first bracket 102, second bracket 104, upper support member 105, floor member 118 and the other components of firearm rack kit 100 are configured to pack flat together when not mounted to wire shelf system 101. The components of firearm rack kit 100 being configured to pack together flat help makes shipping firearm rack kit 100 less expensive and more space efficient.

The reader can see in FIGS. 1-5 that first bracket 102, second bracket 104, upper support member 105, and floor member 118 are formed from metal plates. However, these components may be composed of any currently known or later developed material suitable for bracket and support applications. Suitable materials include metals, polymers, ceramics, wood, and composite materials.

The brackets may be any currently known or later developed type of bracket. Various bracket types exist and could be used in place of the brackets shown in the figures. In addition to the types of brackets existing currently, it is contemplated that the firearm rack kits described herein could incorporate new types of brackets developed in the future.

The number of brackets in the firearm rack kit may be selected to meet the needs of a given application. The reader should appreciate that the number of brackets may be different in other examples than is shown in the figures. For instance, some firearm rack kit examples include additional or fewer brackets than described in the present example.

The size and shape of the brackets may be varied as needed for a given application. In some examples, the brackets are larger relative to the other components than depicted in the figures. In other examples, the brackets are smaller relative to the other components than depicted in the figures. Further, the brackets and the other components may all be larger or smaller than described herein while maintaining their relative proportions.

Main Member

The role of main member 109 is to cooperate with other components of first bracket 102 to releasably mount first bracket 102 to wire shelf 103. Further, main member 109 serves to support upper support member 105.

With reference to FIGS. 1, 3, and 5, upper support member 105 releasably couples to main member 109. As shown in FIGS. 1, 3, and 5, main member 109 is configured to be disposed on a first side of lip 111 of wire shelf 103.

As shown in FIGS. 1 and 2, main member 109 defines three fastener ports 115 and coupling rail 112 defines three ports 130. Some bracket examples include additional or fewer ports than described in the present example.

Fastener ports 115 and rail ports 130 are complementarily configured with fastener 114. The size and shape of the ports may be varied as needed for a given application, such as to be compatible with different sized fasteners. In some examples, the ports are larger relative to the other components than depicted in the figures. In other examples, the ports are smaller relative to the other components than depicted in the figures. Further, the ports and the other components may all be larger or smaller than described herein while maintaining their relative proportions.

The reader can see in FIG. 1 that fastener ports 115 of first bracket 102 and rail ports 130 of coupling rail 112 are aligned when first bracket 102 is releasably mounted to wire shelf 103. As depicted in FIG. 1, fastener ports 115 and rail ports 130 are aligned with a gap between support wires of wire shelf 103. The alignment of fastener ports 115 and rail ports 130 enables fasteners 114 to selectively compress lip 111 between main member 109 and coupling rail 112 to secure first bracket 102 to wire shelf 103.

In the present example, the main member is composed of metal. However, the main member may be composed of any currently known or later developed material suitable for bracket applications. Suitable materials include metals, polymers, ceramics, wood, and composite materials.

The size and shape of the main member may be varied as needed for a given application. In some examples, the main member is larger relative to the other components than depicted in the figures. In other examples, the main member is smaller relative to the other components than depicted in the figures. Further, the main member and the other components may all be larger or smaller than described herein while maintaining their relative proportions.

Coupling Rail

Coupling rail 112 functions to cooperate with main member 109 and fastener 114 to secure first bracket 102 to wire shelf 103. With reference to FIG. 1, coupling rail 112 is configured to be disposed on a second side of lip 111 of wire shelf 103. The second side is opposite the first side of lip 111.

As shown in FIG. 1, coupling rail 112 defines three rail ports 130. Rail ports 130 are complementarily configured with fastener 114.

The reader can see in FIG. 1 that fastener ports 115 of first bracket 102 and rail ports 130 of coupling rail 112 are aligned when first bracket 102 is releasably mounted to wire shelf 103. As depicted in FIG. 1, fastener ports 115 and rail ports 130 are aligned with a gap between support wires of wire shelf 103. The alignment of fastener ports 115 and rail ports 130 enables fasteners 114 to selectively compress lip 111 between main member 109 and coupling rail 112 to secure first bracket 102 to wire shelf 103.

The size and shape of the coupling rail may be varied as needed for a given application. In some examples, the coupling rail is larger relative to the other components than depicted in the figures. In other examples, the coupling rail is smaller relative to the other components than depicted in the figures. Further, the coupling rail and the other components may all be larger or smaller than described herein while maintaining their relative proportions.

In the present example, the coupling rail is composed of metal. However, the coupling rail may be composed of any currently known or later developed material suitable for bracket applications. Suitable materials include metals, polymers, ceramics, wood, and composite materials.

Fastener

The reader can see in FIG. 1 that fastener 114 is configured to couple main member 109 to coupling rail 112 through lip 111 of wire shelf 103. In the present example, fastener 114 is threaded. Rotating fastener 114 in a first direction compresses lip 111 of the shelf between coupling rail 112 and main member 109. Rotating fastener 114 in an opposite direction allows coupling rail 112 and main member 109 to be separated.

The number of fasteners in the firearm rack kit may be selected to meet the needs of a given application. The reader should appreciate that the number of fasteners may be different in other examples than is shown in the figures. For instance, some firearm rack kit examples include additional or fewer fasteners than described in the present example.

In the present example, fastener 114 is a bolt. However, the fastener may be any currently known or later developed type of fastener. Various fastener types exist and could be used in place of the fastener shown in the figures. In addition to the types of fasteners existing currently, it is contemplated that the firearm rack kits described herein could incorporate new types of fasteners developed in the future.

Upper Support Member

Upper support member 105 functions to support firearms resting against it. In particular, upper support member 105 supports barrel 107 of firearm 108.

As shown in FIGS. 1 and 3-5, upper support member 105 is configured to span between first bracket 102 and second bracket 104. Further, upper support member 105 is configured to releasably couple to first bracket 102 and to second bracket 104.

As depicted in FIGS. 1 and 4, upper support member 105 is disposed closer to a rear of wire shelf system 101 than butt support member 119. Upper support member 105 being disposed closer to a rear of wire shelf system 101 than butt support member 119 serves to tilt firearm 108 rearward. In particular, firearm 108 tilts rearward when barrel 107 rests against upper support member 105 and butt 120 rests on butt support member 119 mounted to floor member 118.

The reader can see in FIGS. 1 and 3 that upper support member 105 defines a barrel cutout 106. The barrel cutouts are discussed in detail in the barrel cutouts section below.

With reference to FIGS. 1-3, upper support member 105 includes a cushion layer 127 disposed along an edge of barrel cutout 106. Cushion layer 127 is discussed further in the cushion layer section below.

As shown in FIG. 5, upper support member 105 includes a bumper 131 disposed proximate to a vertical support member 132 of wire shelf system 101. Bumper 131 is discussed further in the bumper section below.

The upper support member may be any currently known or later developed type of firearm barrel support member. Various barrel support member types exist and could be used in place of the upper support member shown in the figures. In addition to the types of barrel support members existing currently, it is contemplated that the firearm rack kits described herein could incorporate new types of upper support members developed in the future.

The number of upper support members in the firearm rack kit may be selected to meet the needs of a given application. The reader should appreciate that the number of upper support members may be different in other examples than is shown in the figures. For instance, some firearm rack kit examples include additional or fewer upper support members than described in the present example.

The size and shape of the upper support member may be varied as needed for a given application. In some examples, the upper support member is larger relative to the other components than depicted in the figures. In other examples, the upper support member is smaller relative to the other components than depicted in the figures. Further, the upper support member and the other components may all be larger or smaller than described herein while maintaining their relative proportions.

In the present example, the upper support member is composed of metal with rubber padding. However, the upper support member may be composed of any currently known or later developed material suitable for barrel support applications. Suitable materials include metals, polymers, ceramics, wood, and composite materials.

Barrel Cutouts

Barrel cutout 106 is configured to receive and support a barrel 107 of a firearm 108. As depicted in FIGS. 1 and 3, barrel cutout 106 is open towards a front of wire shelf system 101 opposite the rear of wire shelf system 101. In the example depicted in FIGS. 1 and 3, barrel cutout 106 being open toward the front of wire shelf system 101 allows one facing the front of wire shelf system 101 to easily insert barrel 107 into barrel cutout 106 or remove barrel 107 from barrel cutout 106.

The reader can see in FIGS. 1-3 that upper support member 105 defines a plurality of laterally adjacent barrel cutouts, of which barrel cutout 106 is one of them. The number of barrel cutouts in the firearm rack kit may be selected to meet the needs of a given application. The reader should appreciate that the number of barrel cutouts may be different in other examples than is shown in the figures. For instance, some firearm rack kit examples include additional or fewer barrel cutouts than described in the present example.

The size and shape of the barrel cutouts may be varied as needed for a given application. In some examples, the barrel cutouts are larger relative to the other components than depicted in the figures. In other examples, the barrel cutouts are smaller relative to the other components than depicted in the figures. Further, the barrel cutouts and the other components may all be larger or smaller than described herein while maintaining their relative proportions.

Cushion Layer

Cushion layer 127 reduces or eliminates the risk of upper support member 105 damaging or marring barrel 107 when barrel 107 enters or exits barrel cutout 106. However, the cushion layer is optional and not included in all examples.

As shown in FIGS. 1-3, cushion layer 127 disposed along an edge of barrel cutout 106. Cushion layer 127 covering an edge of barrel cutout 106 distributes impact forces over a wider area when barrel 107 is inserted into barrel cutout 106.

Distributing impact forces over a wider area reduces or eliminates the risk of the edge of barrel cutout 106 damaging or marring barrel 107.

In the present example, cushion layer 127 is composed of rubber. However, the cushion layer may be composed of any currently known or later developed material suitable for cushion or padding applications. Suitable materials include metals, polymers, ceramics, wood, and composite materials.

The size and shape of the cushion layer may be different than depicted in the figures. In some examples, the cushion layer covers more or less of the upper support member than cushion layer 127 does in the figures.

In some examples, all barrel cutouts are covered by a cushion layer. In other examples, only selected barrel cutouts are covered by a cushion layer. In certain examples, none of the barrel cutouts are covered by a cushion layer.

Bumper

With reference to FIG. 5, bumper 131 is configured to restrict upper support member 105 from moving laterally relative to wire shelf system 101. Bumper 131 restricts upper support member 105 from moving laterally by abutting vertical support member 132 of wire shelf system 101.

As shown in FIG. 5, bumper 131 disposed proximate to a vertical support member 132 of wire shelf system 101 when upper support member 105 is releasably mounted to wire shelf 103. The reader can see in FIG. 5 that bumper 131 is secured to a bumper bracket 133. Bumper bracket 133 is fastened to a rear of upper support member 105.

In the present example, upper support member 105 includes two bumpers and bumper brackets. In other examples, the upper support member includes a single bumper and bumper bracket. In select examples, the upper support member does not include a bumper or a bumper bracket.

The size and shape of the bumper may be varied as needed for a given application. In some examples, the bumper is larger relative to the other components than depicted in the figures. In other examples, the bumper is smaller relative to the other components than depicted in the figures. Further, the bumper and the other components may all be larger or smaller than described herein while maintaining their relative proportions.

In the present example, the bumper is composed of rubber. However, the bumper may be composed of any currently known or later developed material suitable for bumper applications. Suitable materials include metals, polymers, ceramics, wood, and composite materials.

Floor Member

Floor member 118 functions to support butt support member 119. Further, floor member 118 enables butt support member 119 to be positioned in a variety of positions.

The reader can see in FIGS. 1 and 3-5 that floor member 118 is releasably secured to wire shelf system 101. In the present example, floor member 118 rests on a lower shelf of wire shelf system 101. As further shown in FIGS. 1 and 3-5, floor member 118 is spaced below upper support member 105.

The reader can see in FIGS. 1, 2, 6, and 7 that floor member 118 defines a series of holes 121. Series of holes 121 define a range of positions. Series of holes 121 are complementarily configured with posts 143 of butt support member 119. The complementary configuration of posts 143 and holes 121 enables butt support member 119 to be securely positioned in a variety of positions on floor member 118.

As shown in FIGS. 1 and 3-5, floor member 118 is substantially planar and sized to span the width of wire shelf system 101. However, the size and shape of the floor member may be varied as needed for a given application. In some examples, the floor member is larger relative to the other components than depicted in the figures. In other examples, the floor member is smaller relative to the other components than depicted in the figures. Further, the floor member and the other components may all be larger or smaller than described herein while maintaining their relative proportions.

In the present example, the floor member is composed of metal. However, the floor member may be composed of any currently known or later developed material suitable for base support applications. Suitable materials include metals, polymers, ceramics, wood, and composite materials.

Butt Support Member

Butt support member 119 functions to support butt 120 of firearm 108. In the present example, butt support member 119 pivotally supports butt 120.

As depicted in FIGS. 1 and 3-7, butt support member 119 is releasably supported on floor member 118. As further shown in FIGS. 1 and 3-7, butt support member 119 is configured to support butt 120 of firearm 108 when a barrel 107 of firearm 108 is received in barrel cutout 106.

Figure 6:
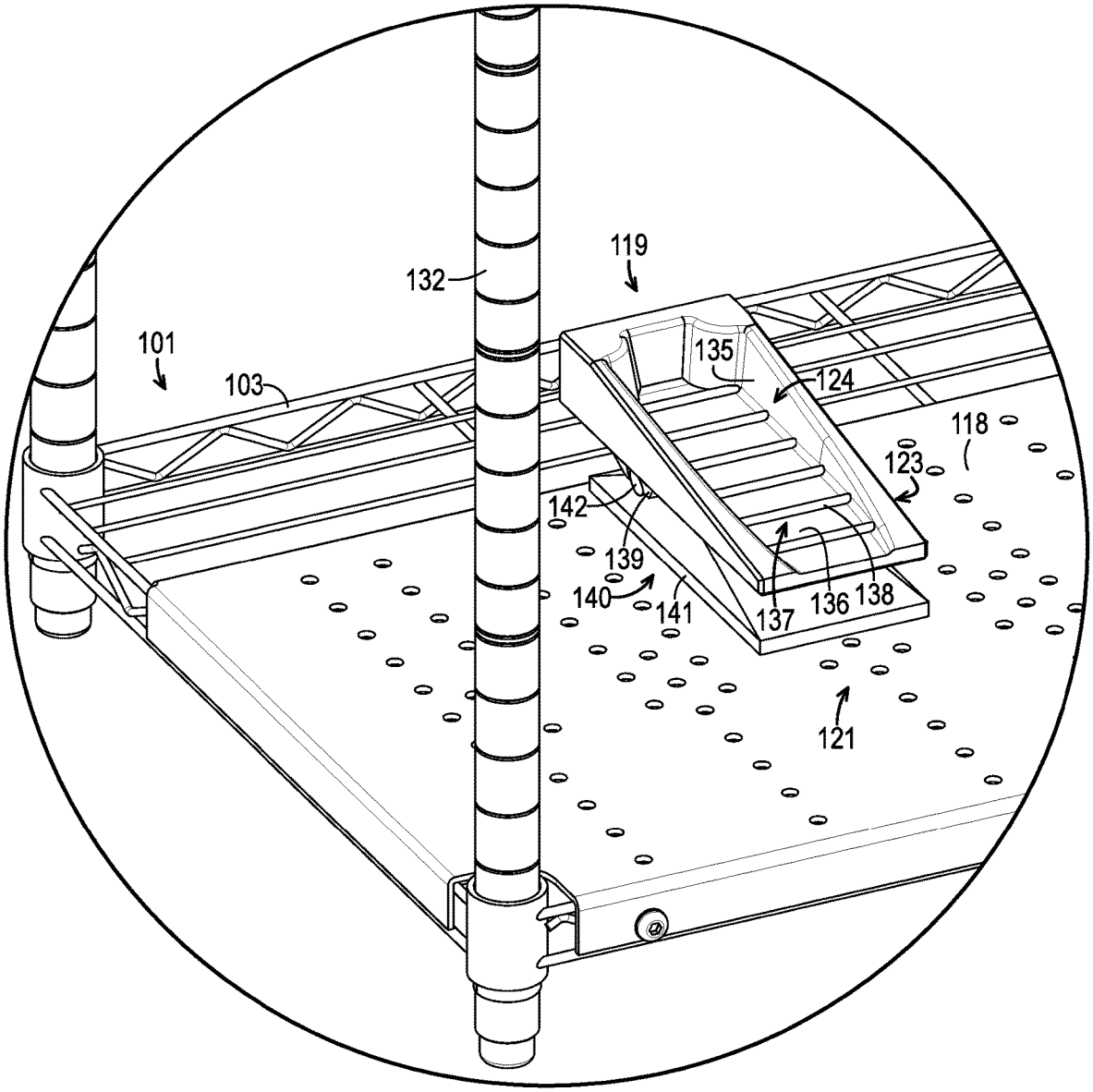
FIG. 6 is a close-up view of a butt support member of the firearm rack kit shown in FIG. 1 supported in a first location on a floor member.
Figure 7:
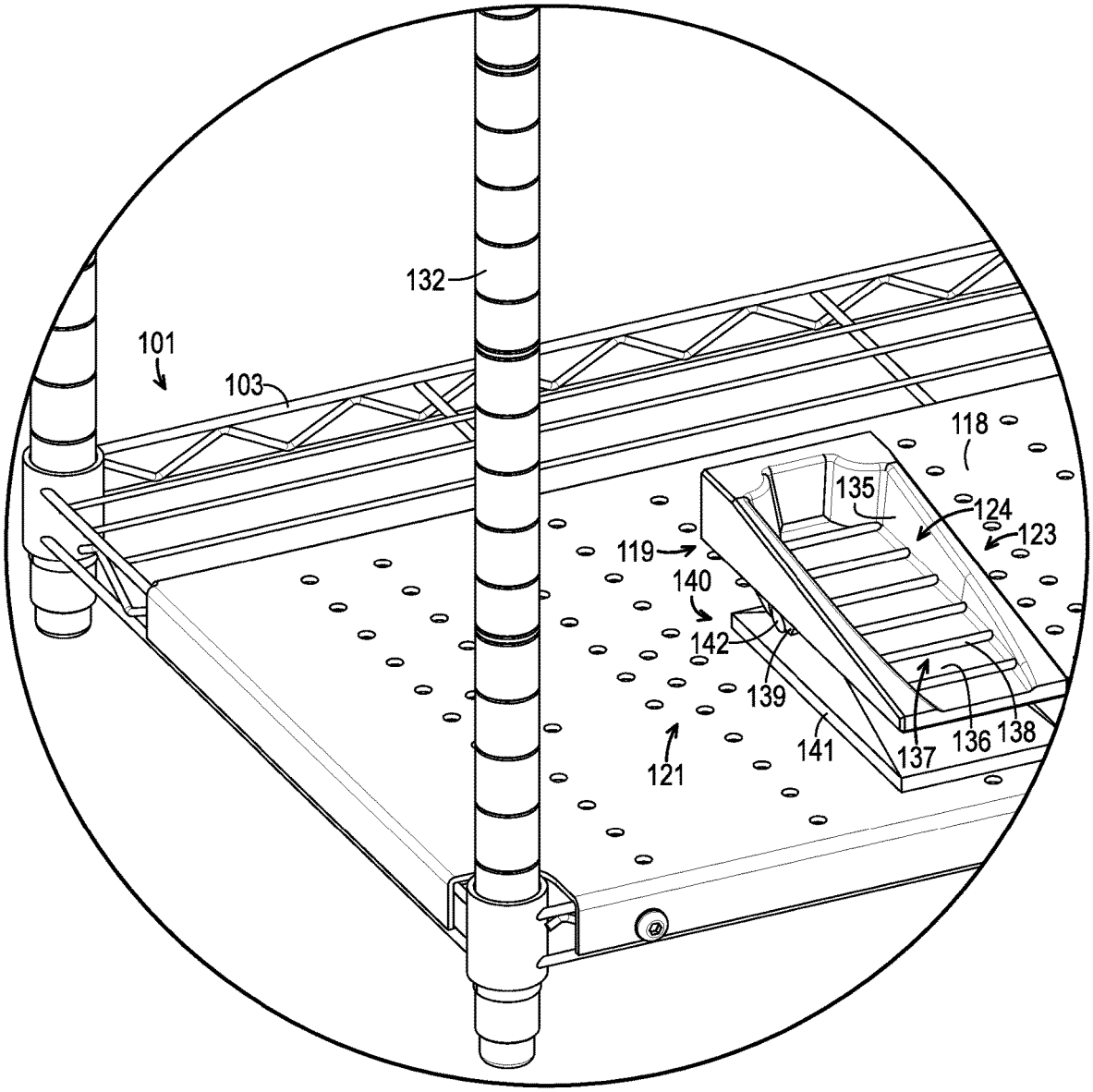
FIG. 7 is a close-up view of the butt support member shown in FIG. 1 supported in a second location on a floor member.

With reference to FIGS. 6 and 7, butt support member 119 and floor member 118 cooperate to adjust the position of butt support member 119 relative to floor member 118. As shown in FIGS. 6, 7, and 9, butt support member 119 is configured to secure to one or more selected holes in series of holes 121. Butt support member 119 securing to selected holes functions to position butt support member 119 in a desired position within a range of positions enabled by series of holes 121.

The reader can see in FIGS. 6-8 that butt support member 119 includes a body 123 and a base 140. The components of butt support member 119 are discussed further in the sections below.

Body

Body 123 functions to receive and support butt 120 from multiple sides. Body 123 further functions to pivot relative to base 140 to facilitate tilting firearm 108. Tilting firearm 108 causes firearm 108 to rest more securely within barrel cutout 106.

In further detail, with reference to FIGS. 1, 4, and 8, body 123 is configured to pivot relative to base 140. Body 123 pivoting relative to base 140 selectively tilts firearm 108 relative to upper support member 105. Tiling firearm 108 towards upper support member 105 causes barrel 107 of firearm 108 to rest against and within barrel support cutout 106.

As shown in FIGS. 6-8, body 123 defines a butt support recess 124 and includes two bearing members 139. Butt support recess 124 and bearing members 139 are discussed in the sections below.

The size and shape of the body may be varied as needed for a given application. In some examples, the body is larger relative to the other components than depicted in the figures. In other examples, the body is smaller relative to the other components than depicted in the figures. Further, the body and the other components may all be larger or smaller than described herein while maintaining their relative proportions.

Butt Support Recess

The role of butt support recess 124 is to receive and support butt 120. Butt support recess 124 is complementarily configured with butt 120 to receive and support butt 120. As shown in FIGS. 6-8, butt support recess 124 includes sidewalls 135 and a recess surface 136.

Sidewalls 135 function to bound and laterally support butt 120 when resting within butt support recess 124. As shown in FIGS. 6-8, sidewalls 135 bound lateral sides and a rear of butt support recess 124. As further shown in FIGS. 6-8, sidewalls 135 leave an opening at the front of butt support recess 124 to facilitate butt 120 being received in and removed from butt support recess 124.

The reader can see in FIGS. 6-8 that sidewalls 135 are inclined. In particular, sidewalls 135 increase in height when moving from the front of butt support recess 124 to the rear. Sidewalls 135 being inclined facilitates butt 120 being received in and removed from butt support recess 124. The sidewalls being inclined is optional, however, and not all sidewall examples are inclined.

Recess surface 136 functions to support butt 120 from below. As shown in FIGS. 6-8, recess surface 136 is disposed between sidewalls 135.

In the present example, recess surface 136 includes a traction system 137. Traction system 137 inhibits butt 120 from sliding when resting on recess surface 136. The traction system is optional and not all recess surfaces include a traction system.

As shown in FIGS. 6-8, traction system 137 includes a plurality of spaced cross members 138. However, the traction system may incorporate any currently known or later developed array of traction elements, such as arrays used for shoe and tire treads.

The size and shape of the butt support recess may be varied as needed for a given application. In some examples, the butt support recess is larger relative to the other components than depicted in the figures. In other examples, the butt support recess is smaller relative to the other components than depicted in the figures. Further, the butt support recess and the other components may all be larger or smaller than described herein while maintaining their relative proportions.

Bearing Members

Bearing members 139 cooperate with pivot shaft 142 to enable body 123 to pivot relative to base 140. Body 123 pivoting relative to base 140 serves to selectively tilt firearm 108 towards upper support member 105. Tiling firearm 108 towards upper support member 105 causes barrel 107 of firearm 108 to rest against and within barrel support cutout 106.

As shown in FIGS. 8 and 9, each bearing member 139 is fixed to butt support recess 124 and defines a curved bearing surface. The bearing surfaces substantially surround pivot shaft 142. Bearing members 139 move relative to pivot shaft 142 when the curved bearing surfaces slide around an outer surface of pivot shaft 142. Body 123 selectively tilts relative to base 140 when bearing members 139 slide around pivot shaft 142.

The size and shape of the bearing members may be different in different examples. For example, when the pivot shaft is larger, the bearing members will generally be larger as well to accommodate the larger pivot shaft.

Base

Base 140 functions to pivotally support body 123. Base 140 further functions to selectively couple to floor member 118 in a variety of positions.

With reference to FIGS. 1, 4, and 8, body 123 is configured to pivot relative to base 140. Body 123 pivoting relative to base 140 serves to selectively tilt firearm 108 towards upper support member 105. Tiling firearm 108 towards upper support member 105 causes barrel 107 of firearm 108 to rest against and within barrel support cutout 106.

As shown in FIGS. 8 and 9, base 123 includes a base member 141, a pivot shaft 142, and posts 143. The components of base member 141 are discussed further in the sections below.

Base Member

Base member 141 functions to support pivot shaft 142 and posts 143. In the present example, base member 141 is rectangular with a faceted top surface. The faceted top surface supports pivot shaft 142 and provides room for bearing members 139 to move around pivot shaft 142.

However, in other examples, the top surface of the base member is flat and the pivot shaft is spaced above the top surface to provide room for the bearing members. In still further examples, the base member is flat, the pivot shaft is mounted directly on the flat top surface, the pivot shaft extends beyond the lateral sides of the base member, and the bearing members couple to the pivot shaft outside the boundary of the base member.

The size and shape of the base member may be different in different examples. In some examples, the base member is larger or smaller than depicted in the figures.

In the present example, the base member is formed from metal. However, the base member may be formed from any material suitable for support applications, including metals, wood, polymers, and composite materials.

Pivot Shaft

Pivot shaft 142 functions to provide a curved surface over which bearing members 139 may slide to tilt body 123. The size and shape of the pivot shaft may be modified to meet the needs of a given application. In the present example, pivot shaft 142 is formed from metal, but may be formed from any currently known or later developed material suitable for pivot shaft applications.

Posts

Posts 143 serve to mate with holes 121 defined in floor member 118. The reader can see in FIG. 9 that posts 143 extend from a bottom of base member 141. The size and shape of posts 143 are complementarily configured with holes 121. The complementary configuration of posts 143 and holes 121 allows base member 141 to be securely placed in a variety of positions on floor member 118 when posts 143 insert into holes 121.

The reader can see in FIGS. 1, 2, 6, and 7 that holes 121 are arranged in a two holes across pattern towards the rear of floor member 118 and in a single, centrally disposed hole pattern towards the front of floor member 118. Posts 143 are similarly configured in a two posts across pattern towards the rear of base member 141 and in a single post near the front of base member. The pattern of holes and posts helps to ensure butt support member 119 is oriented correctly when mounted to a selected position on floor member 118.

The reader should understand that the pattern and number of holes and posts may be varied in other examples. In some examples, the base includes fewer posts, such as no posts, a single post, or two posts. In other examples, the base includes more posts, such as four or more posts.

Additional Embodiments

With reference to the figures not yet discussed in detail, the discussion will now focus on additional firearm rack kit embodiments. The additional embodiments include many similar or identical features to firearm rack kit 100. Thus, for the sake of brevity, each feature of the additional embodiments below will not be redundantly explained. Rather, key distinctions between the additional embodiments and firearm rack kit 100 will be described in detail and the reader should reference the discussion above for features substantially similar between the different firearm rack kit examples.

Firearm Rack Kit Embodiment Two

Turning attention to FIG. 10, a firearm rack kit 200 will now be described as a second example of a firearm rack kit. As can be seen in FIG. 10, firearm rack kit 200 includes a first bracket 202, a second bracket 204, an upper support member 205, a floor member 218, and a butt support member 219.

The reader can see in FIG. 10 that firearm rack kit 200 differs from firearm rack kit 100 in a few respects. One difference is that first bracket 202 and second bracket 204 selectively mount to a rear of wire shelf 203 rather than to sides of wire shelf 203 like with the brackets in firearm rack kit 100. In some examples, one of the brackets mounts to a rear of the wire shelf and another bracket mounts to a side.

Another distinction apparent from FIG. 10 is that upper support member 205 spans only a portion of the width of wire shelf 203 rather than the entire width like upper support member 105. As shown in FIG. 10, the shorter width of upper support member 205 allows for hanging other items next to upper support member, such as a jacket as depicted in FIG. 10. The width of the upper support member may be wider or narrower than depicted in FIG. 10 to enable supporting a different number of firearms and to provide more or less space beside the upper support member to hang other items.

Firearm Rack Kit Embodiment Three

Turning attention to FIG. 11, a firearm rack kit 300 will now be described as a third example of a firearm rack kit. As can be seen in FIG. 11, firearm rack kit 300 includes a first bracket 302, a second bracket 304, an upper support member 305, a floor member 318, and a butt support member 319.

As shown in FIG. 11, one difference between firearm rack kit 300 and firearm rack kit 100 is that first bracket 302, second bracket 304, and upper support member 305 are formed from structural wire instead of plate metal. The reader can see in FIG. 11 that the structural wire makeup of first bracket 302, second bracket 304, and upper support member 305 is similar to the structural wire makeup of wire shelf 303.

Another difference between firearm rack kit 300 and firearm rack kit 100 is that upper support member 305 defines barrel cutouts on both front and rear sides rather than on just a front side like with upper support member 105. In particular, the reader can see in FIG. 11 that upper support member 305 defines a first barrel cutout 306 and a second barrel cutout 330. As depicted in FIG. 11, first barrel cutout 306 is defined in a front portion of upper support member 305 and second barrel cutout 330 is defined in a rear portion of upper support member 305 opposite the front portion.

A further difference between firearm rack kit 300 and firearm rack kit 100 is that upper support member 305 is supported at a middle depth position on wire shelf system 301 rather than towards the rear of wire shelf system 301. As shown in FIG. 11, the middle depth position and the cutouts on both sides enables upper support member 305 to support barrels resting against its barrel support cutouts from both the front and back of upper support member 305.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A firearm rack kit for a wire shelf system, comprising:

a first bracket complementarily configured with the wire shelf system to releasably mount to a wire shelf of the wire shelf system;

a second bracket complementarily configured with the wire shelf system to releasably mount to the wire shelf of the wire shelf system in a position laterally spaced from the first bracket; and an upper support member configured to span between the first bracket and the second bracket and to releasably couple to the first bracket and to the second bracket;

wherein the upper support member defines a barrel cutout configured to receive and support a barrel of a firearm.

2. The firearm rack kit of claim 1, wherein the first bracket includes:

a main member to which the upper support member releasably couples and configured to be disposed on a first side of a lip of the wire shelf;

a coupling rail configured to be disposed on a second side of the lip of the wire shelf opposite the first side of the lip; and a fastener configured to couple the main member to the coupling rail through the lip of the wire shelf.

3. The firearm rack kit of claim 2, wherein:

the main member defines a first fastener port complementarily configured with the fastener;

the coupling rail defines a second fastener port complementarily configured with the fastener; and the first fastener port and the second fastener port are aligned when the first bracket is releasably mounted to the wire shelf.

4. The firearm rack kit of claim 3, wherein the first fastener port and the second fastener port are aligned with a gap between support wires of the wire shelf.

5. The firearm rack kit of claim 4, wherein:

the fastener is threaded; and rotating the fastener in a first direction compresses the lip of the shelf between the coupling rail and the main member.

6. The firearm rack kit of claim 1, wherein one or more of the first bracket, the second bracket, and the upper support member are formed from metal plates.

7. The firearm rack kit of claim 1, wherein one or more of the first bracket, the second bracket, and the upper support member are formed from structural wire.

8. The firearm rack kit of claim 1, further comprising a floor member spaced below the upper support member and releasably secured to the wire shelf system.

9. The firearm rack kit of claim 8, further comprising a butt support member releasably supported on the floor member and configured to support a butt of a firearm when a barrel of the firearm is received in the barrel cutout.

10. The firearm rack kit of claim 9, wherein the butt support member and the floor member cooperate to adjust the position of the butt support member relative to the floor member.

11. The firearm rack kit of claim 10, wherein:

the floor member defines a series of holes defining a range of positions; and the butt support member is configured to secure to one or more selected holes in the series of holes to position the butt support member in a desired position within the range of positions.

12. The firearm rack kit of claim 9, wherein the butt support member includes a body defining a butt support recess complementarily configured with a butt of a firearm.

13. The firearm rack kit of claim 12, wherein the butt support recess includes:

sidewalls; and a recess surface disposed between the inclined sidewalls and including a traction system to inhibit the butt sliding relative to the recess surface when resting on the recess surface.

14. The firearm rack kit of claim 9, wherein the butt support member is configured to pivot to selectively tilt the firearm towards a back of the upper support member to cause a barrel of the firearm to rest against the barrel cutout.

15. The firearm rack kit of claim 14, wherein:

the upper support member is disposed closer to a rear of the wire shelf system than the floor member; and the barrel cutout is open towards a front of the wire shelf system opposite the rear of the wire shelf system.

16. The firearm rack kit of claim 1, wherein the upper support member includes a cushion layer disposed along an edge of the barrel cutout.

17. The firearm rack kit of claim 1, wherein:

the barrel cutout defines a first barrel cutout;

the first barrel cutout is defined in a front portion of the upper support member;

the upper support member defines a second barrel cutout; and the second barrel cutout is defined in a rear portion of the upper support member opposite the front portion.

18. The firearm rack kit of claim 1, wherein:

the upper support member includes a bumper disposed proximate to a vertical support member of the wire shelf system when the upper support member is releasably mounted to the wire shelf; and the bumper is configured to restrict the upper support member from moving laterally relative to the wire shelf system by abutting the vertical support member of the wire shelf system.

19. The firearm rack kit of claim 1, wherein the first bracket, the second bracket, and the upper support member are substantially planar and configured to pack flat together when not mounted to the wire shelf system.

20. The firearm rack kit of claim 1, wherein the upper support member defines a plurality of laterally adjacent barrel cutouts.

* * * * *